US009718169B2

(12) United States Patent
Roeck et al.

(10) Patent No.: US 9,718,169 B2
(45) Date of Patent: Aug. 1, 2017

(54) TOOL HOLDER AND HANDHELD ABRADING MACHINE

(71) Applicant: Flex-Elektrowerkzeuge GmbH, Steinheim/Murr (DE)

(72) Inventors: Dirk Roeck, Ingersheim (DE); Udo Panzer, Weissach (DE); Nazim Sabuncuoglu, Ludwigsburg (DE)

(73) Assignee: Flex-Elektrowerkzeuge GmbH, Steinheim/Murr (DE)

( * ) Notice: Subject to any disclaimer, the term of this patent is extended or adjusted under 35 U.S.C. 154(b) by 0 days.

(21) Appl. No.: 14/922,290

(22) Filed: Oct. 26, 2015

(65) Prior Publication Data

US 2016/0184973 A1 Jun. 30, 2016

Related U.S. Application Data

(63) Continuation of application No. PCT/EP2014/063996, filed on Jul. 1, 2014.

(30) Foreign Application Priority Data

Jul. 5, 2013 (DE) ..... 10 2013 213 272

(51) Int. Cl.

| | |
|---|---|
| ***B24D 9/08*** | (2006.01) |
| ***B24B 23/02*** | (2006.01) |
| ***B24D 13/14*** | (2006.01) |
| ***B24B 23/00*** | (2006.01) |

(52) U.S. Cl.

CPC ..... *B24D 9/08* (2013.01); *B24B 23/005* (2013.01); *B24B 23/02* (2013.01); *B24D 9/085* (2013.01); *B24D 13/14* (2013.01); *B24D 13/142* (2013.01)

(58) Field of Classification Search

CPC ..... B24B 23/005; B24B 23/02; B24D 9/08; B24D 9/085; B24D 13/14; B24D 13/142; B24D 13/147

USPC ..... 451/359, 490, 495, 913

See application file for complete search history.

(56) References Cited

U.S. PATENT DOCUMENTS

| | | | | |
|---|---|---|---|---|
| 2,749,681 A * | 6/1956 | Reidenbach | ..... | B24D 7/12 451/527 |
| 3,395,417 A * | 8/1968 | Matouka | ..... | B24D 9/08 15/230 |
| 3,754,359 A * | 8/1973 | Scandaletos | ..... | B24D 7/10 451/449 |

(Continued)

FOREIGN PATENT DOCUMENTS

| | | |
|---|---|---|
| DE | 6809106 | 4/1969 |
| DE | 4136169 | 5/1993 |

(Continued)

OTHER PUBLICATIONS

International Search Report for corresponding application PCT/EP2014/063996, dated Oct. 22, 2014, 2 pages.

*Primary Examiner* — Eileen Morgan
(74) *Attorney, Agent, or Firm* — Lipsitz & McAllister, LLC

(57) ABSTRACT

In order to provide a tool holder for holding a tool for treating the surface of a workpiece by means of which it is possible to treat workpieces in a low-vibratory and convenient manner, it is proposed that the tool holder comprise a disk-shaped base body which has an attachment section for the attachment of the tool holder to a machine tool and at least one resiliently flexible deformation section.

16 Claims, 3 Drawing Sheets

(56) References Cited

U.S. PATENT DOCUMENTS 4,287,685 A * 9/1981 Marton ..... B24D 9/08 451/359
4,683,683 A * 8/1987 Block ..... B24D 9/085 451/509
4,932,163 A * 6/1990 Chilton ..... B24B 55/102 451/359
5,458,532 A * 10/1995 Cannone ..... A47L 11/162 451/350
5,807,161 A * 9/1998 Manor ..... B24B 23/00 451/442
5,911,620 A * 6/1999 Spangenberg ..... B24D 7/18 451/540
5,979,024 A * 11/1999 Renwick ..... A44B 18/00 24/442
5,989,112 A * 11/1999 Long ..... B24B 55/10 451/456
6,640,377 B2 * 11/2003 Krause ..... B24B 23/022 15/230
7,458,884 B2 * 12/2008 Falk ..... B24B 55/102 451/359
7,901,274 B2 * 3/2011 Montabaur ..... B24D 13/12 451/178
2004/0009744 A1 * 1/2004 Conley ..... B24D 7/10 451/359
2004/0166788 A1 * 8/2004 Travis ..... B24D 11/02 451/359
2006/0189268 A1 * 8/2006 Falk ..... B24B 55/102 451/359
2008/0171498 A1 * 7/2008 Woods ..... B24B 23/00 451/342
2009/0083916 A1 * 4/2009 Lampka ..... B24B 23/028 15/3.53
2012/0276824 A1 * 11/2012 Marton ..... B24B 55/102 451/488
2013/0210325 A1 * 8/2013 Schnyder ..... B24B 55/102 451/488
2015/0056898 A1 * 2/2015 Christen ..... B24B 55/10 451/488

FOREIGN PATENT DOCUMENTS

DE 10354653 6/2005
DE 102008027141 * 12/2009 ..... B24D 7/06
DE EP 2189098 A2 * 5/2010 ..... A47L 11/16
DE 102012213749 2/2014
FR 2140917 1/1973
GB 2323891 10/1998
NL EP 0836911 A1 * 4/1998 ..... B24D 9/08
WO 2008/014807 2/2008

* cited by examiner

TOOL HOLDER AND HANDHELD ABRADING MACHINE

RELATED APPLICATION

This application is a continuation of international application No. PCT/EP2014/063996 filed on Jul. 1, 2014, and claims the benefit of German application No. 10 2013 213 272.7 filed on Jul. 5, 2013, which are incorporated herein by reference in their entirety and for all purposes.

FIELD OF DISCLOSURE

The present invention relates to a tool holder for holding a tool for the purposes of treating the surface of a workpiece, and in particular to a tool holder of an abrading machine in the form of a so-called long-neck abrader.

BACKGROUND

In the case of a tool holder for example, provision may be made for a rigid base body on which a tool such as an abrading disk in particular can be arranged.

SUMMARY OF THE INVENTION

The object of the present invention is to provide a tool holder for holding a tool for treating the surface of a workpiece by means of which it is possible to treat workpieces in a low-vibratory and convenient manner.

In accordance with the invention, this object is achieved by a tool holder for holding a tool for treating the surface of a workpiece, wherein the tool holder comprises a disk-shaped base body which has an attachment section for the attachment of the tool holder to a machine tool and at least one resiliently flexible deformation section.

Due to the fact that, in accordance with the invention, the base body of the tool holder has an attachment section and at least one resiliently flexible deformation section, vibrations occurring when the machine tool is in operation can preferably be reduced. A particularly convenient way of treating workpieces can thereby be obtained.

The at least one resiliently flexible deformation section is preferably flexible when the machine tool is in a working mode. In particular, adaptation of the base body and/or the tool to the surface of a workpiece can be obtained by means of the at least one resiliently flexible deformation section. For example, an inclined orientation of the tool holder relative to the surface of the workpiece can be at least partly compensated.

It can be expedient if at least one resiliently flexible deformation section of the base body is substantially annular.

In particular, provision may be made for at least one resiliently flexible deformation section of the base body to be substantially circular.

At least one resiliently flexible deformation section is preferably of varying flexibility, particularly of periodically varying flexibility in a circumferential direction.

As an alternative or in addition thereto, provision may be made for at least one resiliently flexible deformation section to be uniformly flexible in a circumferential direction.

The attachment section of the base body is preferably arranged centrally on the base body.

In particular, provision may be made for the attachment section to be arranged in the region of a rotational axis of the tool holder.

At least one resiliently flexible deformation section of the base body surrounds the attachment section of the base body, preferably, at least approximately concentrically.

The attachment section and/or the at least one resiliently flexible deformation section are preferably substantially rotationally symmetrical about the rotational axis of the tool holder.

It can be expedient if at least one resiliently flexible deformation section is formed by recesses and/or cut-outs, in particular, by slit-like through-openings and/or by round through-openings, in the base body.

In particular, provision may be made for at least one resiliently flexible deformation section to be formed by curved slit-like through-openings in the base body such as, for example, through-openings which are in the shape of segments of a circle, segments of involutes and/or segments of a spiral.

In one embodiment of the invention, provision is made for at least one resiliently flexible deformation section to be surrounded by, in particular, an annular e.g. circular, thickened portion of the material of the base body.

The thickened portion of material is preferably a thickened portion of material extending in the circumferential direction.

It can be expedient if the base body has a plurality of resiliently flexible deformation sections. Thereby, the deformation sections preferably have mutually independent individual features or a plurality of features and/or advantages which are described in connection with the at least one deformation section.

It can be expedient if the base body comprises a synthetic material or is formed of a synthetic material.

As an alternative or in addition thereto, provision may be made for the base body to comprise a metallic material or be formed of a metallic material.

The tool holder preferably comprises an adhesive layer for attaching a tool which is fixed and in particular glued directly or indirectly to the base body.

In particular, the tool is an abrasive means such as an abrasive disk for example.

The adhesive layer preferably comprises a foamed material or is formed from a foamed material.

The tool is preferably fixable to the adhesive layer in releasable manner by means of a hook and loop fastening.

It can be advantageous if the tool holder comprises a damping layer for damping vibrations which is arranged between the base body and the tool.

The damping layer preferably comprises a foamed material or is formed from a foamed material.

Provision may be made for the adhesive layer to be a layer which differs from the damping layer.

However, as an alternative thereto, provision could be made for the adhesive layer and the damping layer to be formed by a single layer consisting, in particular, of a foamed material.

The base body, an adhesive layer of the tool holder and/or a tool receivable by means of the tool holder are preferably at least approximately rotationally symmetrical and/or point-symmetrical, taken in particular with respect to a rotational axis of the tool holder.

It can be advantageous if at least one resiliently flexible deformation section is surrounded by at least one stiffening section or stabilizing section of the base body.

In particular, provision may be made for at least one resiliently flexible deformation section to be surrounded annularly by at least one stiffening section or stabilizing section of the base body.

The at least one stiffening section or stabilizing section of the base body is preferably formed in such a way that, even in the case of a local application of force and/or in the case of a deformation of the at least one resiliently flexible deformation section, the at least one stiffening section or stabilizing section maintains an annular shape lying in one plane. In this way, in particular, an optimized grinding result may be obtained when the tool holder is mounted on a grinding machine and used for surface grinding.

It can be expedient if at least one stiffening section or stabilizing section of the base body is formed by one or more thickened portions of material of the base body.

In particular, provision may be made for at least one stiffening section or stabilizing section of the base body to be formed by one or more annularly closed thickened portions of material of the base body.

The tool holder is particularly suitable for use in a handheld abrading machine or as a component of a handheld abrading machine.

Consequently, the present invention also relates to a handheld abrading machine which comprises a tool holder in accordance with the invention.

The handheld abrading machine preferably incorporates particular ones or a plurality of the features and/or advantages described in connection with the tool holder in accordance with the invention.

Furthermore, it can be expedient if the handheld abrading machine comprises the following:

a holding device for holding the abrading machine, a drive motor and a tool head on which the tool holder is arranged or is arrangeable, wherein the holding device comprises a substantially tubular bar having a proximal end and a distal end, wherein the drive motor is arranged at the proximal end, wherein the tool head is arranged at the distal end, wherein the abrading machine comprises a transmission shaft which connects the drive motor to a tool holder of the tool head for transmitting torque thereto and which extends at least in sections thereof within the tubular bar.

The handheld abrading machine is, in particular, in the form of a so-called long-neck abrader.

Furthermore, the tool holder in accordance with the invention and/or the handheld abrading machine in accordance with the invention may exhibit particular ones or a plurality of the features and/or advantages described hereinafter:

The base body of the tool holder is preferably a stabilizing element which receives and passes on forces occurring when the abrading machine is in operation, and in particular transfers a rotational movement of a drive shaft (transmission shaft) from a drive motor to the tool arranged on the base body.

By means of the attachment section, the base body is preferably arranged on a tool head of the machine tool and in particular of the abrading machine, for example, the base body is rotationally fixed to the drive shaft.

In particular, the tool holder is settable into rotation. For example, provision may be made for an eccentric and/or concentric rotational movement about a rotational axis of the transmission shaft (drive shaft).

An adhesive layer and/or a damping layer of the tool holder can be glued to the base body or screwed onto it particularly in the form of a pad.

The adhesive layer is preferably provided with a surface which is remote from the base body and which can interact with a surface of the tool remote from an abrading side in the form of a hook and loop fastening.

When the abrading machine is in operation, the vibrations which occur are preferably damped by the damping layer and/or the adhesive layer. Residual vibrations however may be transferred to the abrading machine and the user will be made aware of them by the jerky running of the abrading machine. Preferably, a reduction in the transmitted vibrations and thus steadier running of the machine tool and in particular the abrading machine can be achieved by means of the tool holder in accordance with the invention, in particular, by means of the at least one resiliently flexible deformation section of the disk-shaped base body.

For example, the base body may be in the form of a carrier plate and in particular a plate of synthetic material.

Preferably, at least one resiliently flexible deformation section is formed by especially arc-shaped slits or grooves in the base body.

At least one resiliently flexible deformation section preferably enables a spannular action of the base body, in particular due to the provision of a torsional rigidity in preferably the radial direction and/or in the circumferential direction, for the purposes of transferring the rotational movement of the drive shaft (transmission shaft) to the tool.

The cut-outs and in particular the through-openings by means of which at least one resiliently flexible deformation section is preferably formed can be arranged in an internal region of the base body for example and thus, in particular, can be closed.

In the case of at least one resiliently flexible deformation section however, provision could also be made for the cut-outs forming this deformation section, and particularly through-openings, to extend up to an outer edge. The outer edge of the base body is interrupted by means of these through-openings and thus preferably and in particular interrupted periodically.

In particular, due to such through-openings that are open to the outer edge, a simple adaptation of the tool holder and of the tool arranged thereon to a surface of the workpiece can be achieved if the tool holder is set at an angle to the surface of the workpiece.

Further preferred features and/or advantages of the invention form the subject matter of the following description and the graphical illustration of exemplary embodiments.

BRIEF DESCRIPTION OF THE DRAWINGS

Similar or functionally equivalent elements are provided with the same reference symbols in all the Figures.

DETAILED DESCRIPTION OF THE DRAWINGS

Figure 1:
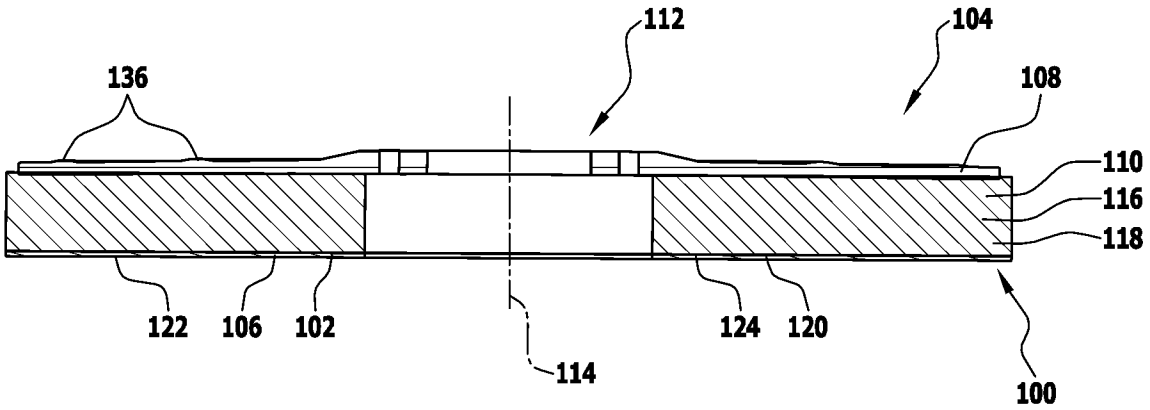
FIG. 1 shows a schematic vertical section through a first embodiment of a tool holder for holding a tool for treating the surface of a workpiece in which a substantially solid base body is provided.

A first embodiment of a tool holder bearing the general reference 100 which is illustrated in FIG. 1 serves for holding a tool 102 used for the treatment of a surface of a workpiece.

The tool holder 100 may, in particular, be a component of a handheld abrading machine 104.

The abrading machine 104 is, in particular, a so-called long-neck abrader.

The tool holder 100 enables, in particular, a tool 102 in the form of an abrasive disk 106 to be held.

To this end, the tool holder 100 comprises a base body 108 and an adhesive layer 110.

The base body 108 is substantially disk-shaped and is formed from a synthetic material for example.

In particular, the base body 108 comprises an attachment section 112 which is arranged centrally on the base body 108.

The base body 108 and thus too the entire tool holder 100 can be fixed to a (not illustrated) tool head of the abrading machine 104 by means of the attachment section 112.

The attachment section 112 and the entire base body 108 are preferably rotationally symmetrical with respect to a rotational axis 114 of the tool holder 100.

The entire tool holder 100 including a tool 102 arranged thereon is preferably rotatable about the rotational axis 114 when the abrading machine 104 is in operation.

The adhesive layer 110 is preferably glued to the base body 108. However, provision could also be made for the adhesive layer 110 to be in the form of a pad and be screwed onto the base body 108.

The adhesive layer 110 is formed, in particular, by an adhesive element 116.

The adhesive element 116 is made from a foamed material for example and is thus resiliently flexible.

On the one hand thereby, the adhesive element 116 forms the adhesive layer 110 for attaching the tool 102. The adhesive element 116 on the other hand forms a damping layer 118 for damping the vibrations which can occur in operation of the abrading machine 104.

On a side remote from the base body 108, the adhesive element 116 preferably has a surface 120 which is connectable in releasable manner to a surface 124 of the tool 102 that is remote from an abrading side 122 of the tool 102.

In particular, the surfaces 120, 124 form a releasable hook and loop fastener.

Figure 2:
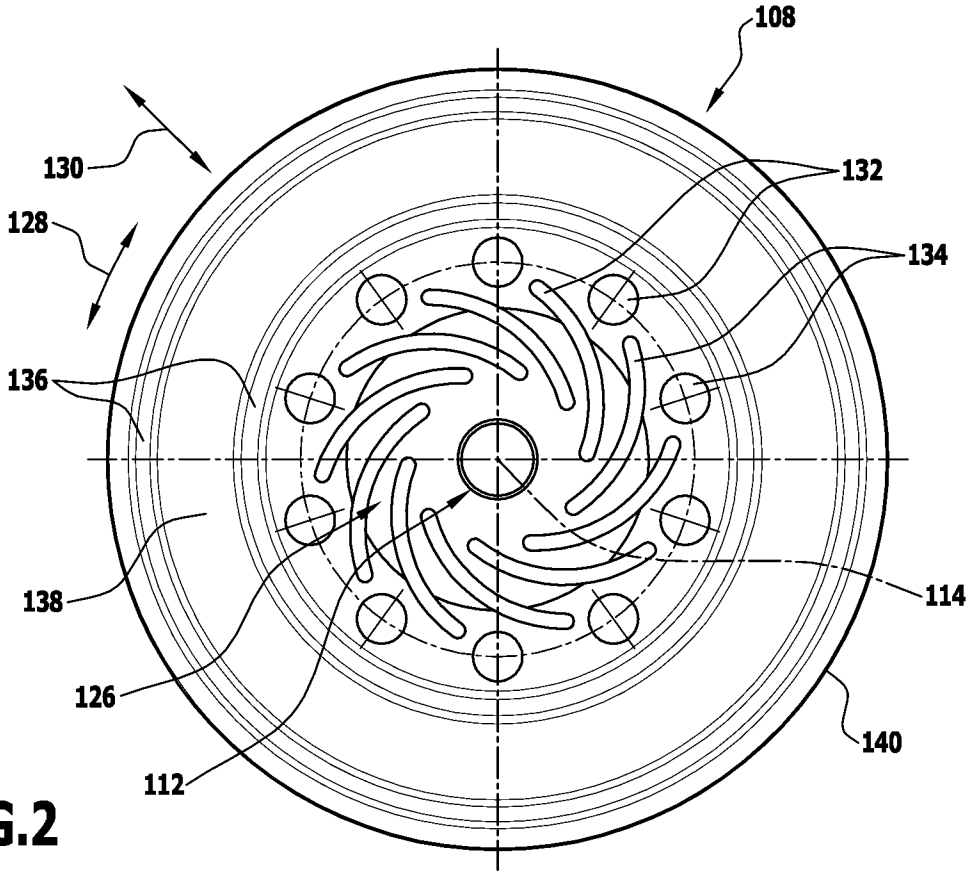
FIG. 2 a schematic plan view of an upper surface of a base body of a second embodiment of a tool holder in which a resiliently flexible deformation section is formed by means of through-openings.

A second embodiment of a tool holder 100 which is illustrated in FIG. 2 differs from the first embodiment illustrated in FIG. 1 mainly in that the base body 108 has a resiliently flexible deformation section 126.

The deformation section 126 is concentric with the attachment section 112 and surrounds the attachment section 112 in substantially circular annular manner.

Thus, with respect to a circumferential direction 128, the deformation section 126 is a surrounding annular deformation section 126.

With respect to a radial direction 130, the deformation section 126 is arranged outside the attachment section 112.

The deformation section 126 is formed by a plurality of recesses 132.

The recesses 132 are circular through-openings 134 and/or slit-like through-openings 134.

The slit-like through-openings 134 are in particular curved slit-like through-openings 134 such as through-openings which are in the shape of segments of a circle, segments of involutes of a circle or segments of a spiral.

A weakened region of the base body 108 forming the deformation section 126 is thus formed by means of the cut-outs 132 and in particular, the through-openings 134.

In operation of the abrading machine 104, the base body 108 can be deformed in resiliently flexible and reversible manner in this deformation section 126.

In particular, the base body 108 can be deformed in spannular manner in the deformation section 126 region.

In addition, in the second embodiment of the tool holder 100 illustrated in FIG. 2, provision is made for the deformation section 126 to be surrounded by a substantially circular annular thickened portion of material 136.

In connection therewith, taken with respect to the radial direction 130, the thickened portion of material 136 is arranged on a side of the deformation section 126 that is remote from the attachment section 112.

Bordering this thickened portion of material 136 in the radially outward direction 130, there is a substantially flat continuous section 138 of the base body 108.

Adjoined thereto in the radial direction 130, there follows a further circular annular thickened portion of material 136 and finally a closed circular outer edge 140 of the base body 108.

Thus, in the second embodiment of the tool holder 100 illustrated in FIG. 2, the thickened portions of material 136, the flat section 138 and the outer edge 140 are moveable as a whole relative to the attachment section 112 and, in particular are resiliently flexible due to the deformation section 126.

In operation of the abrading machine 104, the tool holder 100 and the tool 102 arranged thereon can thus be deformed in directed manner thereby resulting in optimal matching of the tool 102 to the surface of a workpiece which is being worked on.

In all other respects, the second embodiment of the tool holder 100 that is illustrated in FIG. 2 corresponds in regard to the construction and functioning thereof to the first embodiment illustrated in FIG. 1, and insofar, reference is made to the previous description.

Figure 3:
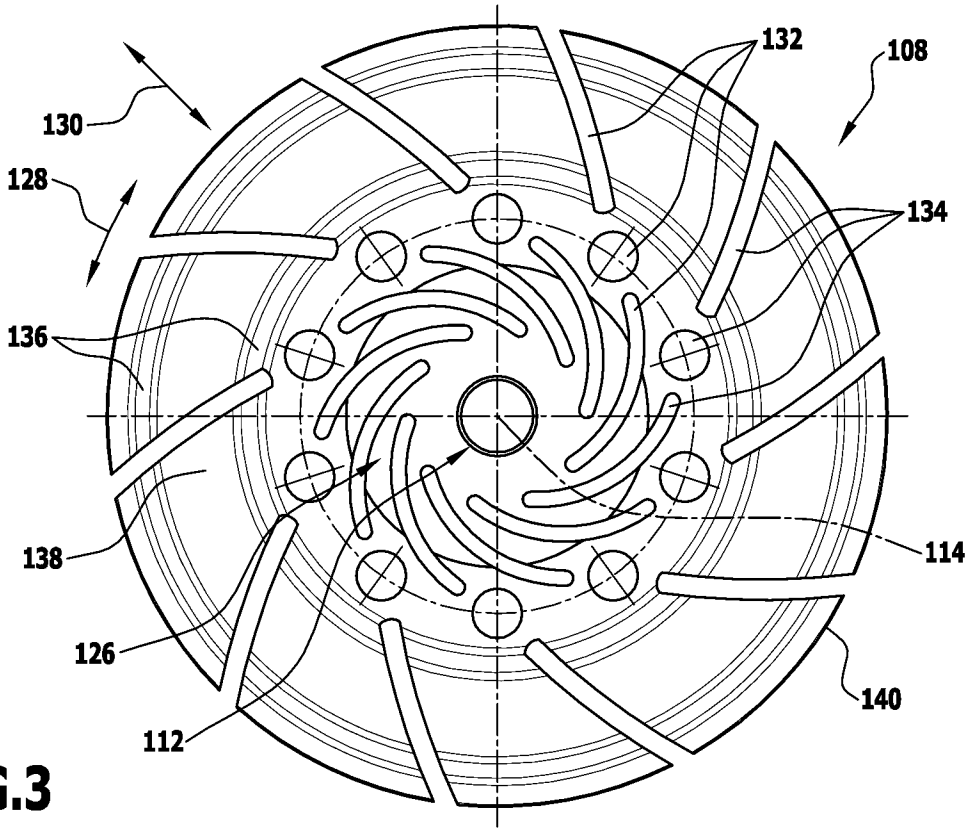
FIG. 3 a schematic plan view corresponding to FIG. 2 of an upper surface of a base body of a third embodiment of a tool holder in which two resiliently flexible deformation sections are provided.

A third embodiment of a tool holder 100 which is illustrated in FIG. 3 differs from the second embodiment illustrated in FIG. 2 mainly in that, in addition to the deformation section 126 which is arranged between the, in the radial direction 130, inwardly located thickened portion of material 136 and the attachment section 112, there is provided a second resiliently flexible deformation section 126.

In connection therewith, the second resiliently flexible deformation section 126 is also formed by means of cut-outs 132, in particular, by means of slit-like through-openings 134.

In particular, the slit-like through-openings 134 are substantially in the form of segments of a circle, segments of involutes or segments of a spiral.

As can be derived from FIG. 3, starting from the deformation section 126 that is located inwardly in the radial direction 130, the through-openings 134 extend through both thickened portions of material 136 and the flat section 138 up to the outer edge 140.

The outer edge 140 is interrupted and in particular, periodically interrupted by means of the slit-like through-openings 134 of the second deformation section 126.

A further resilient deformation of the base body 108 can be achieved by means of this second deformation section 126 when the abrading machine 104 is in operation.

In particular, optimal adjustment to the surface of a workpiece when the tool 102 arranged in the tool holder 100 is applied at an angle to the surface of the workpiece being worked on can be obtained by means of the second deformation section 126. In particular, the results of the abrading process can be optimised thereby.

Due to the fact that in the third embodiment of the tool holder 100 illustrated in FIG. 3 there is also provision for at least one deformation section 126, treatment of workpieces can be effected in a low-vibratory and convenient manner by means of the tool holder 100.

In all other respects, the third embodiment of the tool holder 100 that is illustrated in FIG. 3 corresponds in regard to the construction and functioning thereof to the second embodiment illustrated in FIG. 2, and insofar, reference is made to the previous description.

LIST OF REFERENCE SYMBOLS

100 tool holder
102 tool
104 abrading machine
106 abrasive disk
108 base body
110 adhesive layer
112 attachment section
114 rotational axis
116 adhesive element
118 damping layer
120 surface
122 abrading side
124 surface
126 deformation section
128 circumferential direction
130 radial direction
132 cut-out
134 through-opening
136 thickened portion of material
138 section
140 outer edge

The invention claimed is:

1. A tool holder for holding a tool for treating a surface of a workpiece, comprising:
a disk-shaped base body which comprises:
an attachment section for the attachment of the tool holder to a machine tool, and at least one resiliently flexible deformation section,
wherein:
the at least one resiliently flexible deformation section is formed by at least one of recesses and cut-outs in the base body, and
the at least one resiliently flexible deformation section is surrounded by two annular thickened portions of material of the base body arranged concentrically around a central axis of the base body, the thickened portions having a thickness greater than that of immediately surrounding areas of the base body.

2. A tool holder in accordance with claim 1, wherein the at least one resiliently flexible deformation section of the base body is substantially annular.

3. A tool holder in accordance with claim 2, wherein the at least one resiliently flexible deformation section is of periodically varying flexibility or is uniformly flexible in a circumferential direction.

4. A tool holder in accordance with claim 1, wherein the at least one resiliently flexible deformation section of the base body surrounds the attachment section of the base body at least approximately concentrically.

5. A tool holder in accordance with claim 1, wherein the at least one of recesses and cut-outs comprise at least one of slit-like through-openings and round through-openings.

6. A tool holder in accordance with claim 1, wherein the base body comprises a synthetic material or is formed of a synthetic material.

7. A tool holder in accordance with claim 1, wherein the tool holder, for attaching a tool, further comprises an intermediate layer which is fixed directly or indirectly to the base body.

8. A tool holder in accordance with claim 7, wherein the intermediate layer comprises a foamed material or is formed from a foamed material.

9. A tool holder in accordance with claim 1, wherein the tool is fixable in a releasable manner to the intermediate layer by means of a hook and loop fastening.

10. A tool holder in accordance with claim 1, further comprising a damping layer for damping vibrations arranged between the base body and the tool.

11. A tool holder in accordance with claim 10, wherein the damping layer comprises a foamed material or is formed of a foamed material.

12. A tool holder in accordance with claim 1, wherein at least one of the base body, an intermediate layer of the tool holder, and a tool that is receivable by means of the tool holder are at least one of approximately rotationally symmetrical and point-symmetrical.

13. A tool holder in accordance with claim 1, wherein the thickened portions of the base body are at least one of formed and mounted in such a way that, even in the case of a local application of force and/or in the case of a deformation of the at least one resiliently flexible deformation section, the thickened portions maintain an annular shape lying in one plane.

14. A tool holder in accordance with claim 1, wherein the thickened portions are annularly closed.

15. A handheld abrading machine, comprising:
a tool holder for holding a tool for treating a surface of a workpiece, the tool holder comprising:
a disk-shaped base body which comprises:
an attachment section for the attachment of the tool holder to a machine tool, and at least one resiliently flexible deformation section, wherein:
the at least one resiliently flexible deformation section is formed by at least one of recesses and cut-outs in the base body, and
the at least one resiliently flexible deformation section is surrounded by two annular thickened portions of material of the base body arranged concentrically around a central axis of the base body, the thickened portions having a thickness greater than that of immediately surrounding areas of the base body.

16. A handheld abrading machine in accordance with claim 15, further comprising:
a holding device for holding the abrading machine,
a drive motor, and
a tool head on which the tool holder is arranged or is arrangeable,
wherein:
the holding device comprises a substantially tubular bar having a proximal end and a distal end,
the drive motor is arranged at the proximal end,
the tool head is arranged at the distal end, and
the abrading machine further comprises a transmission shaft which connects the drive motor to the tool holder of the tool head for transmitting torque thereto and extends at least in sections thereof within the tubular bar.

* * * * *